US007226310B1

(12) United States Patent
Dickrell et al.

(10) Patent No.: US 7,226,310 B1
(45) Date of Patent: Jun. 5, 2007

(54) CONTROL APPARATUS

(75) Inventors: Martin Lee Dickrell, Seattle, WA (US); Steven Dale Rees, Bothell, WA (US); Anthony Edward Develice, Mukilteo, WA (US); Alex Brandon Dexter, Lake Stevens, WA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/357,199

(22) Filed: Feb. 21, 2006

(51) Int. Cl.
*H01R 11/00* (2006.01)

(52) U.S. Cl. ..... 439/505; 439/214

(58) Field of Classification Search ..... 439/505, 439/502, 214
See application file for complete search history.

(56) References Cited

U.S. PATENT DOCUMENTS 4,508,399 A * 4/1985 Dowling et al. ..... 439/67
5,037,308 A * 8/1991 Bryce et al. ..... 439/52
5,234,360 A * 8/1993 Kramer, Jr. ..... 439/505
5,862,907 A 1/1999 Taylor

* cited by examiner

*Primary Examiner*—Truc Nguyen
(74) *Attorney, Agent, or Firm*—John A. Kastelic; Marvin E. Union

(57) ABSTRACT

The control apparatus includes a plurality of control units. Each control unit includes a cable containing electrical conductors. Male and female connectors may be disposed at opposite end portions of the cable. An inline connector may be disposed between the male and female connectors and is connected with the electrical conductors. A sensor has terminals which are engagable with terminals in the inline conductor to connect the sensor with the electrical conductors in the cable. Upon disconnection of one sensor from the control apparatus, an electrical connection is maintained with the remaining sensors.

25 Claims, 5 Drawing Sheets

CONTROL APPARATUS

BACKGROUND OF THE INVENTION

The present invention relates to a new and improved control apparatus.

A known control apparatus is utilized in association with a conveyor to control movement of packages or other articles along the conveyor. This known control apparatus includes a plurality of sensors. The sensors are interconnected by integral cables having lengths which are greater than the longest expected length between adjacent sensors. In the event that the apparatus is utilized with shorter spacing between sensors, excess cable is coiled up and stowed. If the sensors were manufactured with integral cables of different lengths to match any length selected by a customer, the manufacturer would have to maintain an inventory which includes a relatively large number of sensors connected with integral cables of different lengths.

With a known control apparatus, a sensor cable may exit from the sensor body in a direction toward a next adjacent sensor in a chain of sensors. If the cable exits from the sensor body in a direction away from the next adjacent sensor in the chain of sensors, the cable would have to be bent 180 degrees and be longer than the desired spacing between sensors to make the next connection. With a known control apparatus, replacement of a damaged sensor requires disconnection of an integral cable associated with the damaged sensor from other sensors and their associated cables. The damaged sensor and its associated cable are then replaced.

SUMMARY OF THE INVENTION

The present invention relates to a new and improved control apparatus which includes a plurality of control units. Each of the control units includes a cable containing electrical conductors. Male and female connectors may be disposed on opposite end portions of the cables to interconnect the cables. An inline connector may be disposed between the male and female connectors and is connected with the electrical conductors. A sensor may have terminals which are engagable with terminals in the inline connector to connect the sensor with the electrical conductors in the cable. Upon disconnection of one sensor from the control apparatus, an electrical connection is maintained with the remaining sensors in the control apparatus through the conductors.

The inline connector may, if desired, be connected with a base. The inline connector may be connected with the base in an orientation in which the cable extends in a first direction from the base or in an orientation in which the cable extends in the opposite direction from the base. Disconnection of the sensor from the inline connector may interrupt one or more of the conductors in the cable without interrupting other conductors.

The present invention has a plurality of features. These features may be utilized together in the manner disclosed herein. Alternatively, the features may be utilized separately or in combination with features from the prior art.

BRIEF DESCRIPTION OF THE DRAWINGS

The foregoing and other features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
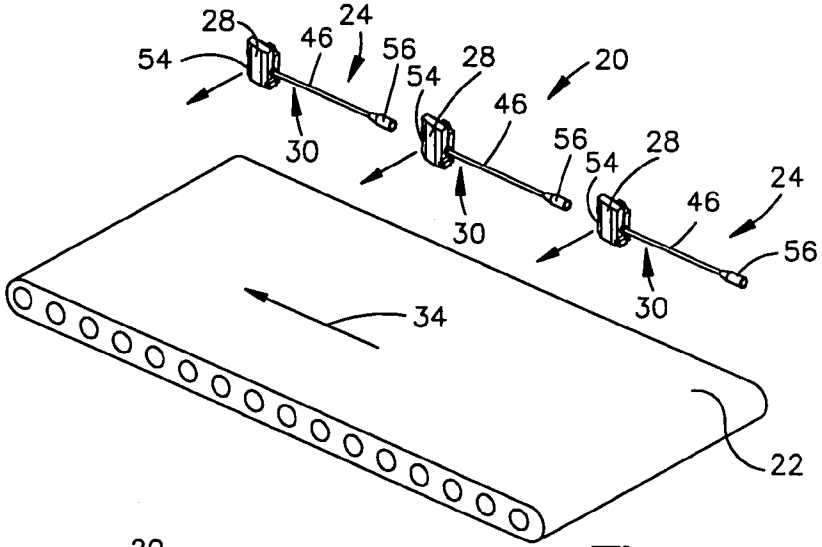
FIG. 1 is a schematic illustration depicting the relationship of an improved control apparatus to a conveyor.

A control apparatus 20, constructed in accordance with the present invention, is illustrated schematically in FIG. 1 in association with a conveyor 22. However, it should be understood that the control apparatus 20 may be utilized in association with devices other than the conveyor 22.

The control apparatus 20 includes a plurality of interconnected control units 24. Although the control units 24 have been illustrated schematically in FIG. 1 as being spaced apart, it should be understood that the control units are interconnected. Although three control units 24 are illustrated in FIG. 1, a greater or lesser number of control units may be provided in the control apparatus 20. For example, six or more control units 24 may be provided in association with the conveyor 22.

Each of the control units 24 includes a sensor 28 and a cordset 30. The cordsets 30 are manufactured separately from the sensors 28. The cordsets 30 are interconnected to electrically interconnect the sensors 28. The cordsets 30 bring power to the sensors 28 and carry signals to, from, and between the sensors 28. The control units 24 may be disposed along either the far side of the conveyor 22 (as shown in FIG. 1) or along the near side of the conveyor.

The conveyor 22 has a known construction and is intermittently operated to convey packages or other items through accumulating zones. The conveyor 22 has a direction of product flow indicated schematically by an arrow 34 in FIG. 1. Operation of the conveyor 10 is interrupted, in response to the control apparatus 20, with each of the packages in an accumulating zone. The conveyor 22 has the same general construction and mode of operation as the conveyor disclosed in U.S. Pat. No. 5,862,907. The disclosure in the aforementioned U.S. Pat. No. 5,862,907 is hereby incorporated herein in its entirety by this reference thereto.

The sensors 28 have the same construction and may be of any known type. For example, the sensors 28 may be photoelectric, infrared, proximity or ultrasonic sensors. The illustrated sensors 28 are of the type which transmit an energy beam which is reflected from a package or other article disposed on the conveyor 22 at a location adjacent to the sensor. However, a separate source of an energy beam may be utilized in association with each sensor. If this is done, the presence of a package or other article would be detected in response to interruption of the energy beam.

Figure 2:
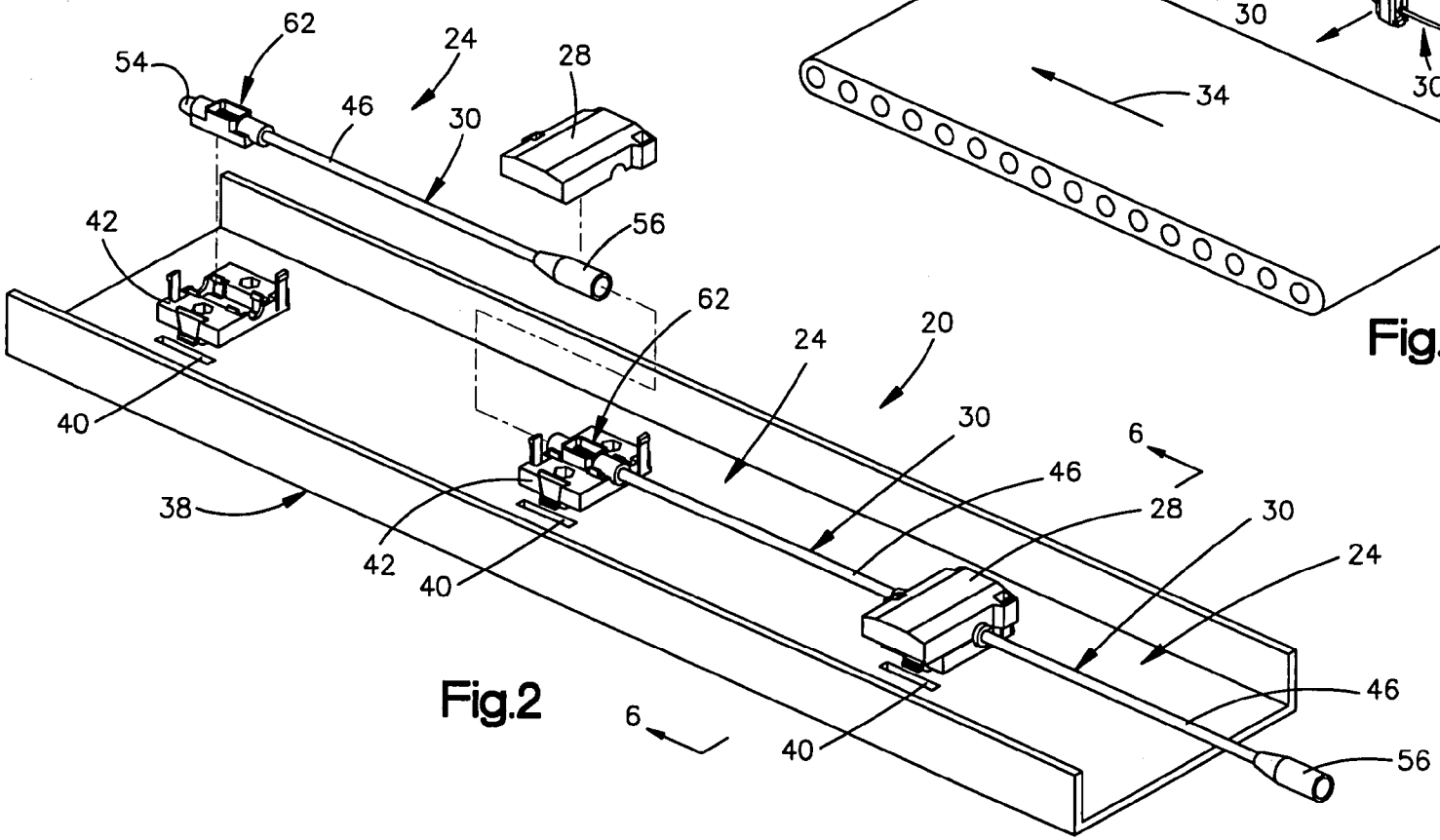
FIG. 2 is a schematic pictorial illustration depicting the manner in which the control apparatus of FIG. 1 may be mounted on a support member.

In the illustrated embodiment of the invention, the control units 24 are mounted on a support member or rail 38 (FIG. 2). The support member or rail 38 is in turn mounted along the conveyor 22 of FIG. 1. Although the control units 24 are disposed on a support formed by a single support member or rail 38, the control units may be disposed on a support constructed with a plurality of support members.

The support member 38 may be formed of a material which does not effect an energy beam transmitted from and/or to the sensors 28. Alternatively, the support member 38 may be provided with openings 40 through which energy beams from and/or to the sensors 28 are transmitted. If desired, the sensors 28 may be mounted on a support member 38 in an orientation in which signal transmitting and/or receiving portions of the sensors are exposed adjacent to a longitudinal edge of the support member.

The adjacent control units 24 are connected in series with each other by their cordsets 30 to form a continuous chain of interconnected control units 24. The claim of interconnected control units 24 is connected with a main control unit or computer (not shown). In the embodiment of the invention illustrated in FIGS. 1 and 2, the sensors 28 are spaced equal distances apart in a linear array along the conveyor 22. Therefore, the cordsets 30 in the control units 24 all have the same length which is determined by the desired spacing between the sensors 28.

However, it should be understood that the sensors 28 may be spaced different distances apart. If this is done, the cordsets 30 would have different lengths. Since the identical sensors 28 are formed separately from the cordsets 30, any one of a plurality of sensors may be connected with any one of a plurality of cordsets having different lengths. Although the sensors 28 have been illustrated as being disposed in a linear array, it is contemplated that the sensors 28 may be disposed in a non-linear array, depending upon the environment in which the control apparatus 20 is to be utilized.

Each control unit 24 is provided with a base 42 (FIG. 3) which is connected with the support member 38. The base 42 in each of the control units 24 is disposed in the same orientation relative to the support member 38. A base 42 and each of the control units 24 is spaced from the base of an adjacent control unit by distance which corresponds to the desired distance between adjacent sensors 28. Although it is preferred to use the bases 42 in association with the cordsets 30, the bases may be omitted if desired, or their features made integral to the cordsets.

Each of the identical bases 42 is integrally formed as one piece of molded polymeric material. However, the base 42 may be formed in a different manner. For example, the base 42 may be formed of a plurality of interconnected pieces. If desired, the base 42 may be formed of two or more materials. For example, the base 42 may be formed of interconnected metal and polymeric components.

Each of the cordsets 30 includes a cable 46 containing electrical conductors or wires 48. The cable 46 has sufficient rigidity to enable the cable to maintain the linear configuration illustrated in FIG. 2. However the cable 46 may be manually deflected to a nonlinear configuration if desired.

A male electrical connector 54 is connected to the left (as viewed in FIG. 3) end portion of the cable 46. A female electrical connector 56 is connected to the right (as viewed in FIG. 3) end portion of the cable 46. Of course, the male connector 54 may be connected with the right end portion of the cable 46 and the female connector connected with the left end portion of the cable. The electrical connectors 54 and 56 are connected with opposite ends of the conductors 48 in the cable 46.

An inline connector 62 (FIG. 3) is connected with the cable 46 at a location between the male connector 54 and female connector 56. The inline connector 62 is utilized to connect the sensor 28 with the conductors 48 in the cable 46. The inline connector 62 includes a socket 64 into which a portion of the sensor 28 is telescopically inserted. When the sensor 28 is to be disconnected from the cable 46, the sensor is pulled from the socket 64.

Figure 3:
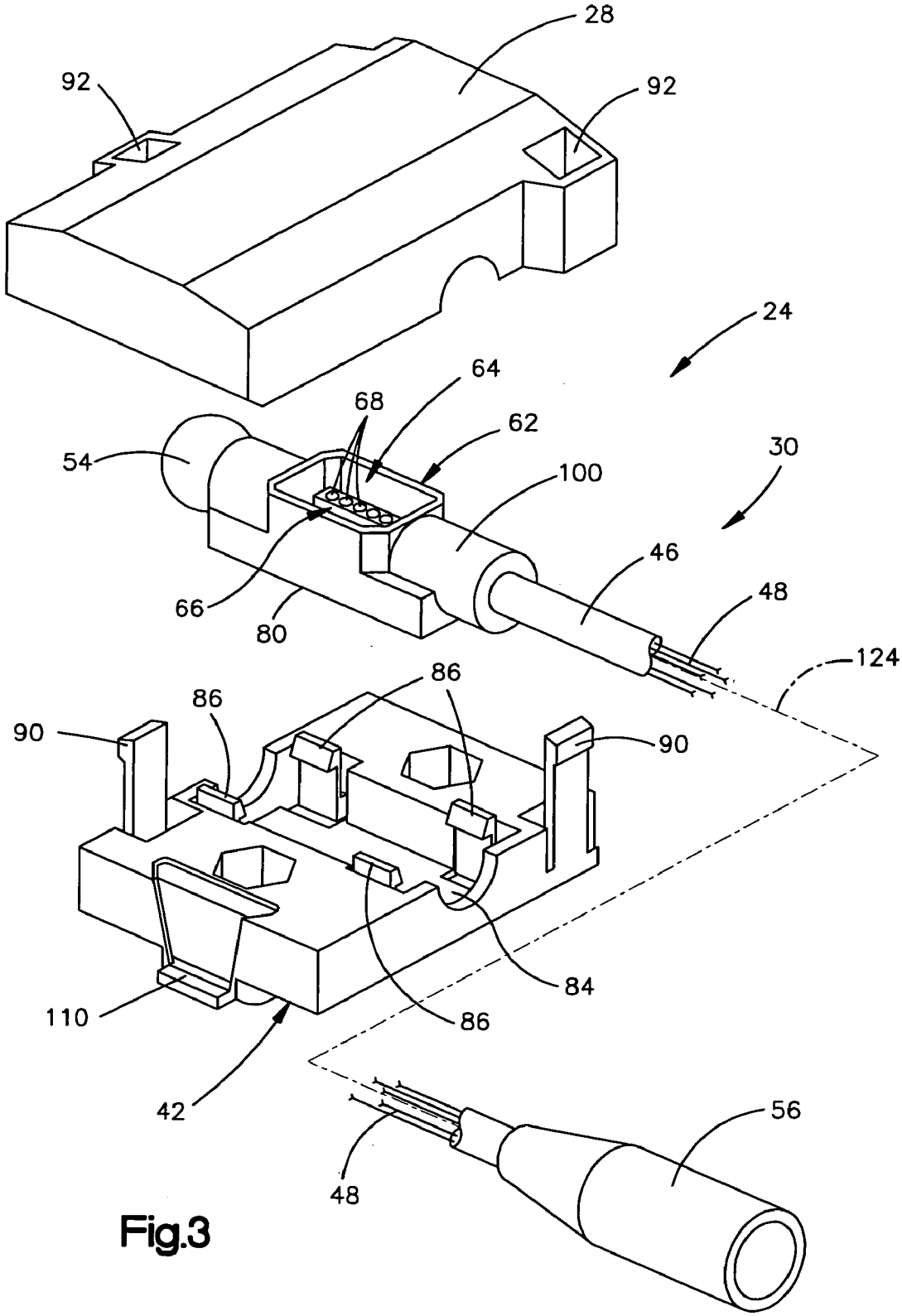
FIG. 3 is an enlarged fragmentary illustration of a base, cordset, and sensor utilized in the control apparatus of FIGS. 1 and 2.

The inline connector 62 has been illustrated in FIG. 3 as being adjacent to the male connector 54. However, the inline connector 62 may be located at any desired location along the cable 46. For example, the inline connector 62 may be located in a central portion of the cable 46.

Figure 6:
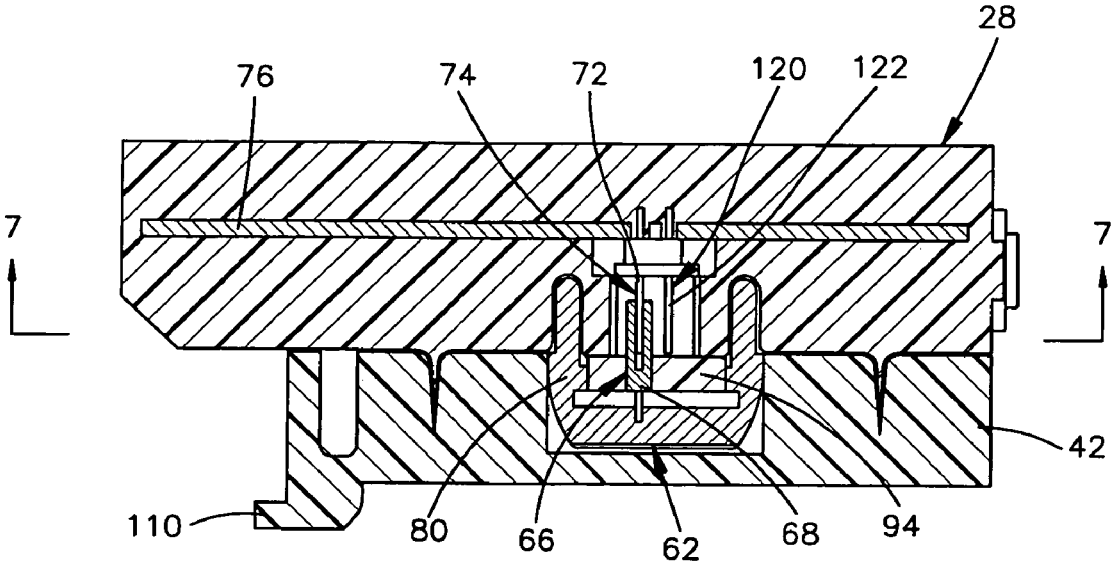
FIG. 6 is a fragmentary sectional view, taken along the line 6—6 of FIG. 2, illustrating the relationship of a sensor to an inline connector and base.

The socket 64 contains a linear array 66 of female terminals 68 (FIG. 6). The female terminals 68 are connected with the conductors 48 in the cable 46. The female terminals 68 in the linear array 66 are telescopically engaged by male terminals 72 disposed in a linear array 74 of terminals on the sensor 28 (FIG. 6). Although male terminals 72 and female terminals 68 are disposed in linear arrays, they may be disposed in nonlinear arrays if desired.

Engagement of the array 74 of male terminals 72 on the sensor 28 with the array 66 of female terminals 68 on the inline connector 62 is effective to connect the sensor 28 with the conductors 48 in the cable 46 (FIG. 3). The male terminals 72 are connected with apparatus on a circuit board 76 (FIG. 6) in the sensor 28. If desired, female terminals may be disposed on the sensor 28 and the male terminals may be disposed in the socket 64.

The inline connector 62 (FIG. 3) includes a generally rectangular housing 80 to which the male electrical connector 54 is connected. The housing 80 is formed of a polymeric material and is received in a generally rectangular cavity 84 formed in the base 42. Although the illustrated housing 80 has a generally rectangular configuration, the housing may have a different configuration if desired.

The base 42 securely grips the housing 80 to hold the inline connector 62 in a desired position relative to the base 42. To grip the housing 80 of the inline connector 62, the base 42 is provided with a plurality of resiliently deflectable retaining tabs 86. The retaining tabs 86 engage the inline connector housing 80 to hold the inline connector 62 in place on the base 42.

The retaining tabs 86 are designed to allow slight movement of the inline connector 62 relative to the base 42. This small amount of movement allows for manufacturing tolerances and permits the terminals 68 on the socket 64 to be readily aligned with the terminals 72 on the sensor 28. It should be understood that the base 42 and housing 80 may be interconnected in a different manner if desired. For example screws may be used to interconnect the base 42 and housing 80. Alternatively or in addition, adhesive may be utilized to interconnect the base 42 and housing 80.

Contemporaneously with connection of the inline connector 62 of one cordset 30 with the base 42, the male connector 54 is connected with a female connector 56 of an adjacent cordset 30. Similarly, the female connector 56 of the one cordset is connected with the male connector 54 of an adjacent cordset. If desired, the male and female connectors 54 and 56 on the adjacent cordsets may be interconnected before the inline connectors 62 are connected with the bases 42.

Once the inline connector 62 has been securely gripped by the retaining tabs 86 of a base 42, the sensor 28 is securely connected with the inline connector. As the sensor 28 is connected with the inline connector 62 and the base 42, the linear array 74 (FIG. 6) of male terminals 72 on the sensor 28 are telescopically inserted into female terminals 68 in the linear array 66 of terminals on the inline connector 62 (FIGS. 3 and 6). Although the sensor 28 is provided with male terminals 72 and the inline connector 62 is provided with female terminals 68, the sensor may be provided with female terminals and the inline connector provided with male terminals. If desired, the sensor 28 may be connected with the inline connector 62 before the inline connector is gripped by the base 42.

As the sensor 28 is positioned relative to the base 42, a pair of resiliently deflectable retaining tabs 90 (FIG. 3) on the base 42 grip the sensor 28 to securely connect the sensor 28 to the base 42. The retaining tabs 90 are received in openings 92 in the sensor 28. As the retaining tabs 90 move into the openings 92, the retaining tabs snap into recesses in sidewalls of the openings. If desired, the retaining tabs 90 may engage the outer side surface areas on the sensor 28.

If a defective sensor 28 is to be replaced the openings 92 provide access to the retaining tabs 90. The retaining tabs 90 are deflected to release the defective sensor from the base 42. The sensor 28, which is to be replaced, is then disconnected from the inline connector 62. A replacement sensor 28 can then be connected to the inline connector 62 from which the defective sensor was disconnected.

A resilient seal 94 (FIG. 6) is provided between the inline connector 62 and the sensor 28. The seal 94 blocks foreign material (contaminants) from entering the joint between the sensor 28 and the inline connector 62. The seal 94 is desirable when the cordset 30 is used in a damp environment. However, when the cordset 30 is used in a dry environment, the seal 94 may be omitted if desired.

The base 42 is connected to the support member 38 (FIG. 2) by suitable fasteners, such as, screws and nuts. Although it is preferred to utilize the base 42 to mount the inline connector 62 on the support member 38, it is contemplated that the base 42 may be eliminated and the housing 80 of the inline connector 62 secured directly to the support member 38 by suitable fasteners. Of course, the inline connector 62 may be secured to the support member 38 in a different manner if desired. For example, retaining tabs on the inline connector 62 may snap into openings in the support member.

The male and female electrical connectors 54 and 56 and the cordset 30 (FIG. 3) enable control units 24 in the linear array of control units (FIG. 2) to be connected in series with each other. Thus, the female connector 56 of a first control unit 24 is telescopically engaged by a male connector 54 of a second control unit to connect the conductors 48 in the cables 46 of the two control units in series with each other. Similarly, the female connector 56 of the second control unit 24 telescopically engages the male connector 54 of the third control unit to connect the first, second, and third control units in series with each other. If desired, the male connector 54 may be connected to the end of the cordset 30 furthest from the inline connector 62 and the female connector 56 connected to the end of the cordset closest to the inline connector.

A continuous chain of any desired length of control units 24 may be formed by interconnecting the female connectors 56 of one control unit with the male connector 54 of the next succeeding control unit. A source of power and a controller (microprocessor) is connected, via T-Cable or other means, with the male electrical connector 54 of a sensor in the chain of control units and/or with the female connector 56 of the neighboring control unit 24 in the chain of control units.

The control units 24 are oriented relative to the conveyor 22 (FIG. 1) with a direction of product flow, indicated by the arrow 34, being from the female electrical connectors 56 toward the sensors 28 and male electrical connectors 54. The female connector 56 is disposed upstream from the base 42 and inline connector 62. If the conveyor 22 is moving product in the opposite direction from the arrow 34, the orientation of the cordsets 30 would be opposite from the orientation illustrated in FIGS. 1 and 2.

Figure 4:
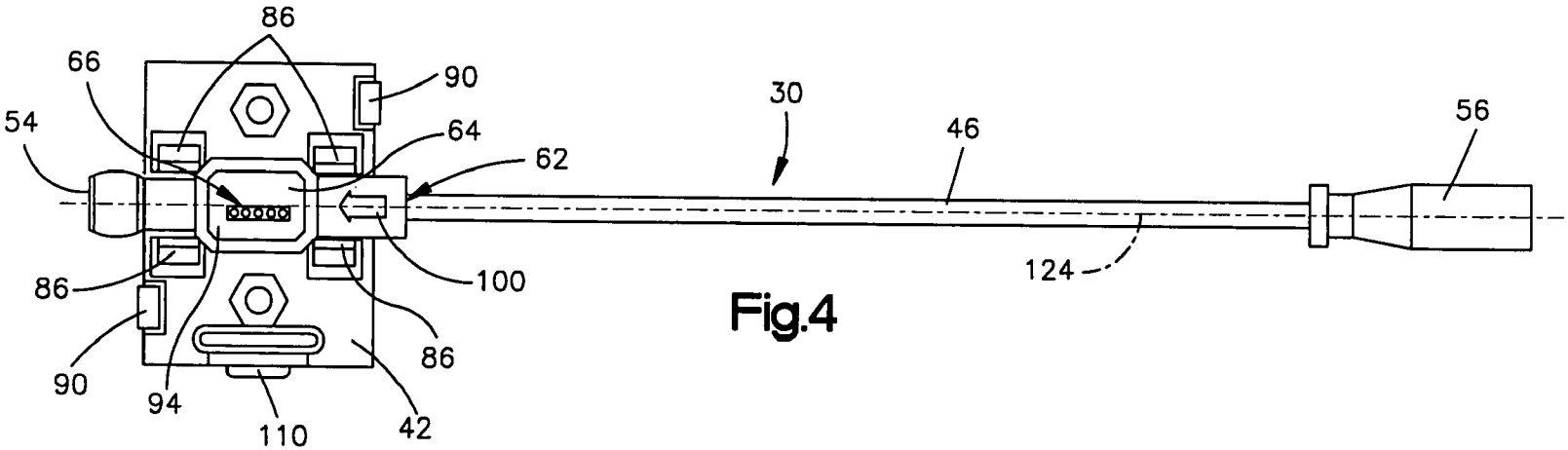
FIG. 4 is a schematic pictorial illustration depicting the relationship of an inline connector and cable in the cordset of FIG. 3 to the base when the cable extends in a first direction from the base.

The direction of product flow is indicated on each cordset 30 by an arrow 100 (FIG. 4). It should be understood that the cordset 30 may be constructed with the positions of the male connectors 54 and female connectors 56 reversed from the positions shown in FIG. 4. If this is done, the male connector 54 would be disposed upstream from base 42 and inline connector 62. It is contemplated to have a zone-controller capable of reversing direction may be utilized.

When the conveyor 22 (FIG. 1) is to be operated to move the product in the direction of the arrow 34, that is, to the left, the cordset 30 is oriented with the cable 46 extending to the right (as viewed in FIGS. 1 and 4) from the base 42. If the conveyor 22 is to be operated to move the product in a direction opposite to the direction of the arrow 34 in FIG. 1, that is, to the right, the cordset 30 is oriented with the cable 46 extending to the left (as viewed in FIGS. 1 and 4) from the base 42 (see FIG. 5).

When the direction of flow of the product is from right to left, the cordset 30 is oriented in the position illustrated in FIG. 4. However, if the direction of product flow is from left to right, the cordset 30 is oriented in the position illustrated in FIG. 5. It should be noted that only the orientation of the cordset 30 is changed.

Regardless of the direction of product flow and the orientation of the cordsets 30, the orientation of the bases 42 relative to the support rail 38 (FIG. 2) is the same. Therefore, the orientation of the base 42 is the same in FIGS. 4 and 5. The retaining tabs 86 on the base 42 (FIG. 3) can engage the inline connector housing 80 when the connector housing is in either the orientation illustrated in FIG. 4 or the opposite orientation illustrated in FIG. 5.

Figure 5:
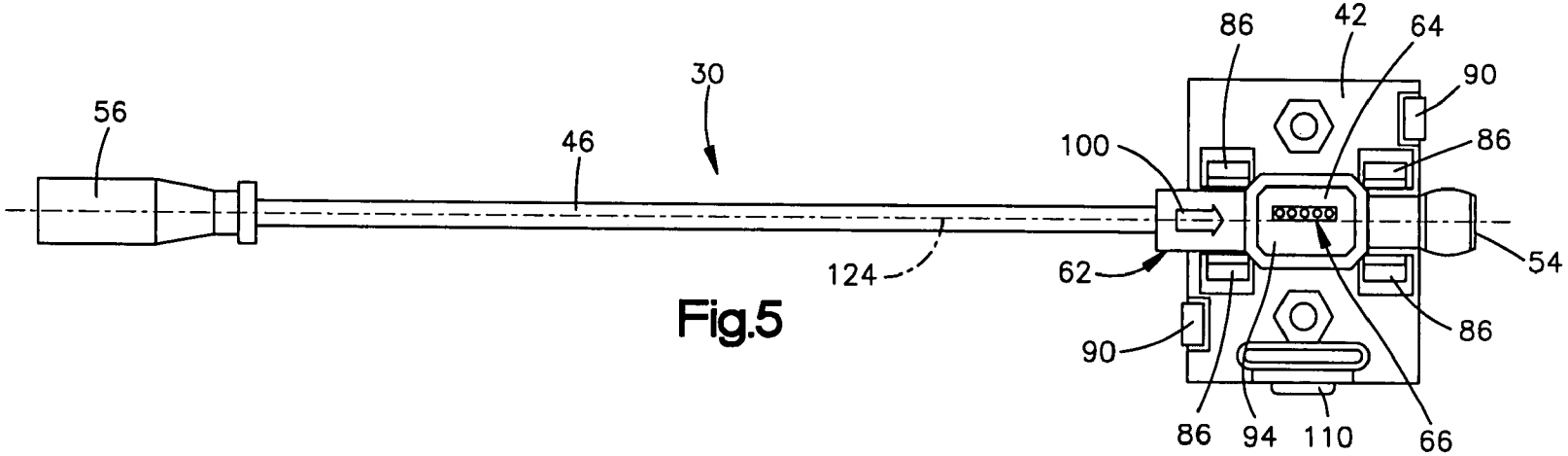
FIG. 5 is a schematic pictorial illustration depicting the relationship of the inline connector and cable to the base when the cable extends in a second direction from the base.

The inline connector 62 is securely gripped by the base 42 when the inline connector is in either the orientation shown in FIG. 4 and the conveyor 22 is moving packages to the left or the orientation shown in FIG. 5 and the conveyor is moving packages to the right. This enables a cordset 30 to be positioned on either side of the conveyor and the conveyor operated in either direction. In FIGS. 4 and 5, the arrows 100 on the inline connectors 62 indicate the direction of product flow.

Regardless of whether the cordset 30 has the orientation illustrated in FIG. 4 relative to the base 42 or the orientation illustrated in FIG. 5 relative to the base, the orientation of the sensor 28 relative to the base 42 is the same. When the sensor 28 is connected with the cordset 30, the sensor will extend downward (as viewed in FIGS. 4 and 5) across a portion of the mounting flange 110 on the base 42 in the manner illustrated in FIGS. 2 and 6.

When the orientation of the cordset 30 is changed from the orientation illustrated in FIG. 4 to the orientation illustrated in FIG. 5, the orientation of the female terminals 68 in the linear array 66 (FIG. 6) of terminals in the inline connector 62 is changed. However, the orientation of the male terminals 72 in the sensor 28 does not change. This is because the sensor 28 is connected with the base 42 in the same orientation when the cordset 30 is in the orientation shown in FIG. 4 and in the orientation shown in FIG. 5. Thus, when the cordset 30 is in the orientation shown in FIG.

4 or the orientation shown in FIG. 5, the sensor 28 extends outward past the mounting flange 110 on the base 42 in the manner illustrated in FIG. 6.

When the orientation of the cordset is reversed between the orientations shown in FIGS. 4 and 5, the orientation of the linear array 66 of female terminals 68 in the inline connector 62 is reversed. Thus, when the cordset 30 is in the orientation illustrated in FIG. 4, the female terminal 68 in the linear array 66 of terminals closest to the male electrical connector 54 is disposed adjacent to the left (as viewed in FIG. 4) edge of the base 42. When the cordset 30 is in the orientation illustrated in FIG. 5, the female terminal 68 in the linear array 66 of terminals closest to the male connector 54 is disposed adjacent to the right (as viewed in FIG. 5) edge of the base 42.

When the orientation of the cordset 30 is reversed between the orientations shown in FIGS. 4 and 5, the orientation of the linear array 66 of terminals in the inline connector 62 is reversed without changing the connections between the terminals and the conductors 48. In order to enable the sensor 28 to be connected with the cordset 30 when it is in either the orientation illustrated in FIG. 4 or in the orientation illustrated in FIG. 5, two sets of terminals are provided on the sensor 28. Thus, in addition to the first linear array 74 (FIG. 6) of male terminals 72, a second linear array 120 of male terminals 122 is provided in the sensor 28.

The male terminals 122 in the second linear array 120 have the same configuration and spacing as the male terminals 72 and the first linear array 74. However, when the sensor 28 is connected with the inline connector 62, the order in which the male terminals 122 in the second linear array are connected with the conductors 48 is reversed relative to the order in which the male terminals 72 and the first linear array 74 are connected with the conductors 48. The first linear array 74 of male terminals 72 in the sensor 28 is connected with the linear array 66 of female terminals in the inline connector 62 when the cordset 30 is in the orientation illustrated in FIGS. 2, 4 and 6. The second linear array 120 of male terminals 122 in the sensor 28 is connected with the linear array 66 of female terminals in the inline connector 62 when the cordset 30 is in the orientation illustrated in FIG. 5.

The linear array 66 of female terminals 68 (FIGS. 3 and 6) in the inline connector 62 is offset from a longitudinal central axis 124 of the inline connector 62 by a distance which is equal to one half of the spacing between the linear arrays 74 and 120 of male terminals on the sensor 28 (FIG. 6). Therefore, when the cordset 30 is in the orientation illustrated in FIG. 4, the linear array 66 of female terminals 68 on the inline conductor 62 engages the linear array 74 of male terminals 72 on the sensor 28 (FIG. 6). When the orientation of the cordset is reversed, to the orientation illustrated in FIG. 5, the linear array 66 of female terminals 68 on the inline conductor 62 engages the linear array 120 of male terminals 122 on the sensor 28.

The manner in which the linear array 66 of terminals is offset from the longitudinal central axis 124 of the inline conductor 62 can be seen by comparison of FIGS. 4 and 5. In FIG. 4, the distance between the mounting flange 110 on the base 42 and the linear array 66 of terminals is less than the distance between the mounting flange 110 and the linear array of terminals 66 when the cordset 30 is in the orientation illustrated in FIG. 5.

Figure 7:
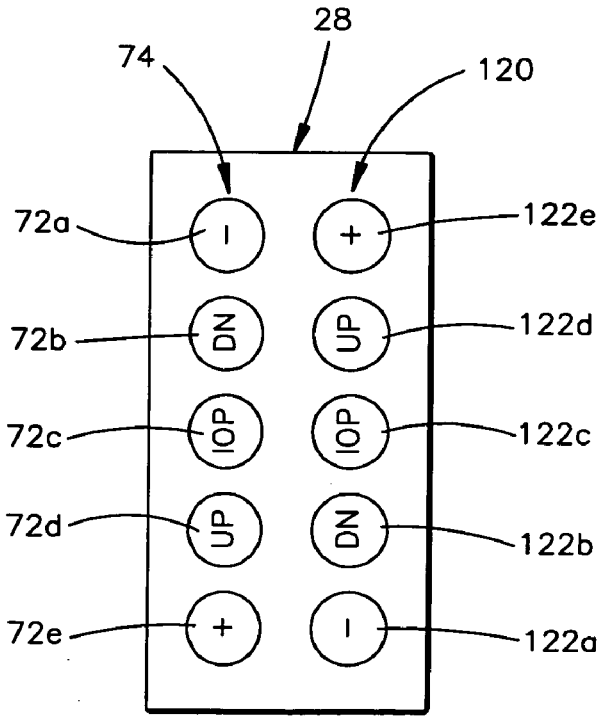
FIG. 7 is a schematic illustration, taken along the line 7—7 of FIG. 6, of terminals utilized in the sensor.

The two arrays 74 and 120 of male terminals on the sensor 28 are illustrated schematically in FIG. 7. The upper (as viewed in FIG. 7) terminal 72*a* in the linear array 74 is connected to the same conductor 48 as the lower (as viewed in FIG. 7) terminal 122*a* in the linear array 120 of sensor terminals. Similarly, the terminal 72*b* in the linear array 74 of sensor terminals is connected to the same conductor 48 as the terminal 122*b* in the linear array 120 of terminals. Similarly, the terminals 72*c* and 122*c* are connected with the same conductor 48. The terminals 72*d* and 122*d* are connected with the same conductor 48. Finally, the terminal 72*e* and 122*e* are connected with the same conductor.

When the cordset 30 is changed from the orientation shown in FIG. 4 to the orientation shown in FIG. 5, the orientation of the linear array 66 of terminals on the inline conductor 62 is reversed. However, the first linear array 74 of male terminals on the sensor 28 engages the linear array 66 of female terminals on the inline connector 62 when the cordset 30 is in the orientation illustrated in FIG. 4. When the cordset 30 is in the orientation shown in FIG. 5, the linear array 66 of female terminals on the inline connector 62 engages the second linear array 120 of terminals on the sensor 28. Therefore, even though the orientation of the cordset 30 is reversed while the orientation of the sensor 28 remains constant, the terminals of the sensor are properly connected with the conductors 48 in either orientation.

In the illustrated embodiment of the invention, the linear arrays 74 and 120 of terminals on the sensor are male terminals. The linear array 66 of terminals on the inline connector 62 are female terminals. This may be reversed if desired. Thus, female terminals may be provided on the sensor 28 and male terminals provided on the inline connector.

In the illustrated embodiment of the invention a single array 66 of terminals is provided on the inline connector 62 and a plurality of arrays 74 and 120 of terminals are provided on the sensor 28. If desired, a single array of terminals may be provided on the sensor 28 and a plurality of arrays of terminals provided on the inline connector 62.

Figure 8:
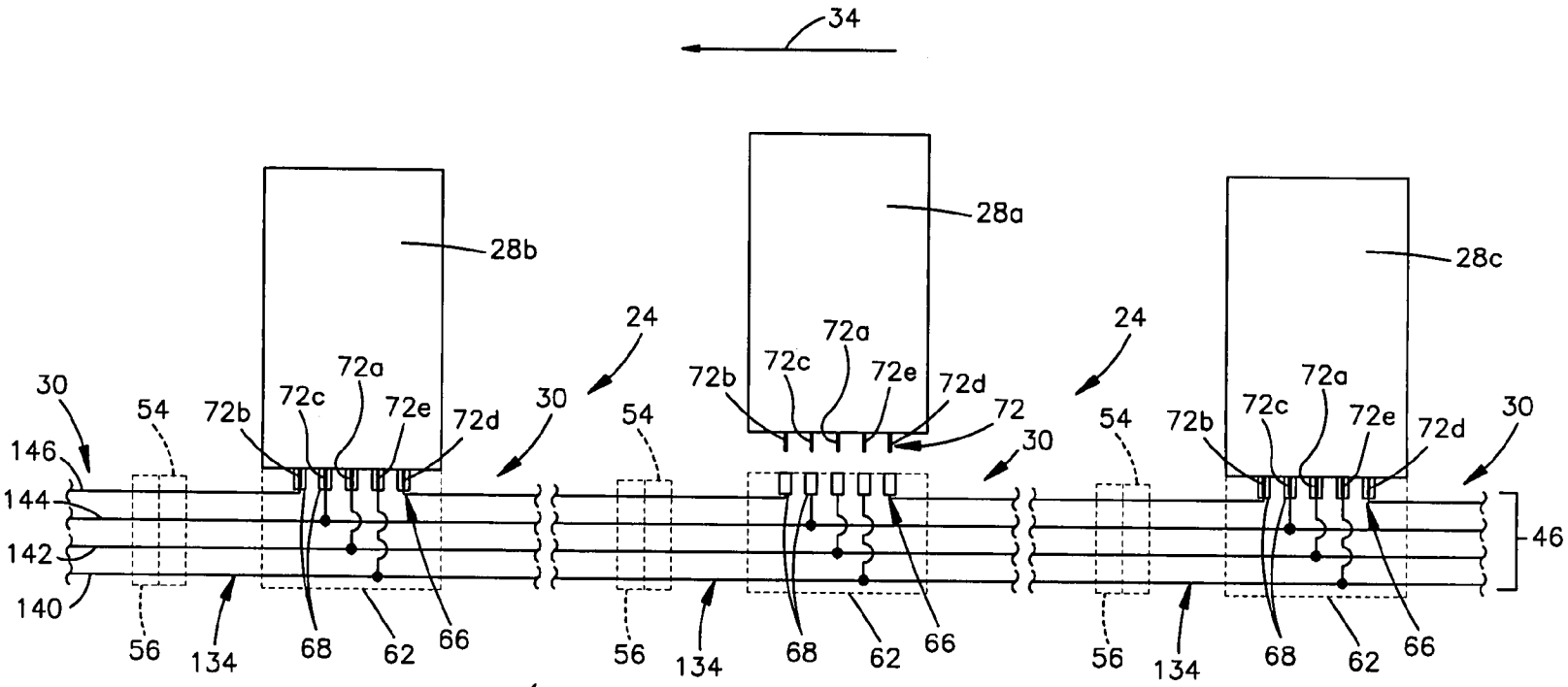
FIG. 8 is a schematic illustration of the control apparatus and illustrates the disconnection of a sensor from the control apparatus.

The control units 24 may be connected together in series, in the manner illustrated schematically in FIG. 8, to form a chain 134 which is disposed along one side of the conveyor 22. Although the conveyor 22 has not been illustrated in FIG. 8, it should be understood that the sensors 28 are positioned along the side of the conveyor to detect the presence of articles at accumulating zones. Although only three sensors 28 have been illustrated in FIG. 8 in the chain 134, it should be understood that there may be a larger number of sensors in the chain. For example, six or more sensors 28 may be provided in the chain 134. Each of the sensors would be disposed in alignment with an accumulating zone on the conveyor 22.

It is contemplated that during extended use of the conveyor 22 (FIG. 1) and apparatus 20, one of the sensors 28 may malfunction. When this occurs, the defective sensor 28 is disconnected from the chain 134 (FIG. 8) and a sensor which is functioning correctly is substituted in its place in the chain. The electrical conductors 48 in the chain 134 are effective to maintain an electrical connection between sensors 28 which are disposed on opposite sides of the defective sensor until the defective sensor is replaced.

In FIG. 8, a defective sensor 28*a* is illustrated as being disposed between a sensor 28*b* which is located downstream from the defective sensor 28*a* and a sensor 28*c* which is located upstream from the defective sensor. By disconnection of the defective sensor 28*a* from the chain 34, in the manner illustrated schematically in FIG. 8, the array 72 of male terminals on the defective sensor 28*a* are disconnected from the array 66 of female terminals 68 in the inline connector 62. Even though the defective sensor 28*a* has been disconnected from the chain 134, the conductors 48 in the chain 134 are effective to maintain an electrical connection between sensors 28 still connected with the chain 134. Thus, an electrical connection is maintained with the sensor 28*b* which is offset in a downstream direction from the disconnected defective sensor 28*a* and with the sensor 28*c* which is offset in an upstream direction from the disconnected defective sensor 28*a*.

The conductors 48 include a power conductor 140, a ground conductor 142, a global communication conductor 144, and a local communication conductor 146. It should be understood that either a greater or lesser number of conductors 48 may be provided in the cordsets 30 which would also be reflected in the number of pins and sockets in arrays 68, 74 and 120.

The sensors 28 (FIG. 8) are connected in parallel with the power conductor 140, ground conductor 142 and global communication conductor 144. Therefore, disconnection of the defective sensor 28*a* from the chain 134 does not interrupt the power conductor 140, the ground conductor 142 and/or the global communication conductor 144. However, the sensors 28 are connected in series with the local communication conductor 146. Therefore, the local communication conductor 146 is interrupted by removal of the defective sensor 28*a*.

Even though the local communication conductor 146 is interrupted by disconnection of the defective sensor 28*a* from the chain 134, the downstream sensor 28*b* can communicate, through the local communication conductor 146, with other sensors (not shown) which are disposed downstream from the sensor 28*b*. Similarly, the upstream sensor 28*c* can communicate, through the local communication conductor 146, with other sensors (not shown) which are disposed upstream from the sensor 28*c*. This enables the control apparatus 20 to be utilized to control operation of the conveyor 22 (FIG. 1) even though a defective sensor 28*a* has been removed from the chain 134. Of course, when the defective sensor 28*a* is disconnected, the operation of the control apparatus will be impaired to the extent that failure to detect an article at an accumulating zone associated with the defective detector 28*a* impairs the operation of the control apparatus. However, the other sensors 28 disposed downstream and upstream from the defective sensor are effective to control operation of the conveyor 22.

In view of the foregoing description, it is apparent that the present invention provides a new and improved control apparatus 20 which includes a plurality of control units 24. Each of the control units 24 includes a cable 46 containing electrical conductors 48. Male and female connectors 54 and 56 may be disposed on opposite end portions of the cable 46 to interconnect the cables. An inline connector 62 may be disposed between the male and female connectors 54 and 56 and is connected with the electrical conductors 48. A sensor 28 may have terminals 72 or 122 which are engagable with terminals 68 in the inline connector 62 to connect the sensor 28 with the electrical conductors 48 in the cable. Upon disconnection of one sensor 28*a* from the control apparatus 20, an electrical connection is maintained with the remaining sensors 28 in the control apparatus 20 through the conductors 48.

The inline connector 62 may, advantageously, be connected with a base 42. The inline connector 62 may be connected with the base 42 in an orientation in which the cable 30 extends in a first direction from the base 42 (FIG. 4) or in an orientation in which the cable extends in the opposite direction (FIG. 5) from the base. Disconnection of one sensor 28*a* from the inline connector 62 may interrupt one or more of the conductors 48 in the cable 46 without interrupting other conductors.

The present invention has a plurality of features. These features may be utilized together in the manner disclosed herein. Alternatively, the features may be utilized separately or in combination with features from the prior art.

The invention claimed is:

1. An apparatus comprising a cable containing electrical conductors, a female connector at a first end portion of said cable and connected with said electrical conductors, a male connector at a second end portion of said cable, an inline connector disposed between said male and female connectors, and a sensor connected with said inline connector, a first one of said sensor and inline connector having first and second series of terminals, a second one of said sensor and inline connector having a third series of terminals, said first series of terminals being disposed in engagement with said third series of terminals when a portion of said cable extends in a first direction from said sensor, said second series of terminals being disposed in engagement with said third series of terminals when said portion of said cable extends in a second direction from said sensor, said second direction being opposite from said first direction.

2. An apparatus as set forth in claim 1 further including a seal member disposed between said inline connector and said sensor to retard movement of foreign material through a joint between said inline connector and said sensor.

3. An apparatus as set forth in claim 1 further including a base when is connectable with a support, said base includes gripper means for gripping said inline connector when said inline connector is in a first orientation relative to said base with said portion of said cable extending in the first direction from said sensor and when said inline connector is in a second orientation relative to said base with said cable extending in the second direction from said sensor.

4. An apparatus comprising a first cable containing first conductors, a first female connector at a first end portion of said first cable and connected with said first conductors in said first cable, a first male connector at a second end portion of said first cable and connected with said first conductors in said first cable, a first inline connector disposed between said first male and first female connectors and connected with said first conductors in said first cable, a first sensor having terminals which are engagable with terminals in said first inline connector to connect said first sensor with said first conductors in said first cable, a second cable containing second conductors, a second female connector at a first end portion of said second cable and connected with said conductors in said second cable, a first male connector at a second end portion of said second cable and connected with said second conductors in said second cable, said first female connector at said first end portion of said first cable being disposed in engagement with said first male connector at said second end portion of said second cable to connect said first conductors in said first cable with said second conductors in said second cable, a second inline connector disposed between said second male and said second female connectors and connected with said second conductors in said second cable, and a second sensor having terminals which are engagable with terminals in said second inline connector to connect said second sensor with said second conductors in said second cable.

5. An apparatus as set forth in claim 4 further including a first base connectable with a support, said first base includes first gripper means for gripping said first inline connector, and a second base connectable with the support, said second base includes second gripper means for gripping said second inline connector.

6. An apparatus comprising a plurality of bases which are connectable with a support, a plurality of cables containing electrical conductors, a plurality of female connectors each of which is disposed at a first end portion of one of said cables and is connected with said electrical conductors, a plurality of male connectors each of which is disposed at a second end portion of one of said cables and is connected with said electrical conductors, a plurality of inline connectors disposed between said male and female connectors and connected with said electrical conductors, each of said inline connectors being connected with one of said bases of said plurality of bases, and a plurality of sensors having terminals which are engagable with terminals in said inline connectors to connect each of said sensors with said electrical conductors, a selected sensor of said plurality of sensors being disconnectable from one of said inline connectors, said electrical conductors being effective to maintain an electrical connection between one of said sensors which is offset in a first direction from the selected one of said sensors and one of said sensors which is offset in a second direction from the selected one of said sensors upon disconnection of said selected one of said sensors from said one of said inline connectors.

7. An apparatus as set forth in claim 6 wherein each one of said inline connectors is connectable with one of said bases of plurality of bases when said one inline connector is in a first orientation relative to said one base with a portion of one of said cables extending in a first direction from said one base and when said one inline connector is in a second orientation relative to said one base with said portion of said one of said cables extending in a second direction from said one base each one of said sensors of said plurality of sensors having a first set of terminals which are engaged by said terminals of said inline connectors when said inline connectors are in the first orientation relative to said base, each one of said sensors of said plurality of sensors having a second set of terminals which are engaged by said terminals of said inline connectors when said inline connectors are in the second orientation relative to said base.

8. An apparatus as set forth in claim 6 wherein said plurality of bases includes gripper means for gripping said inline connectors with said inline connectors in a first orientation relative to said bases and with portions of said cables extending in a first direction from said bases and for gripping said inline connectors with said inline connectors in a second orientation relative to said bases and with said portions of said cables extending in a second direction from said bases said second direction is opposite to said first direction.

9. An apparatus as set forth in claim 6 further including a plurality of seal members each of which is disposed between one of said inline connectors and one of said sensors to retard movement of foreign material through joints between said inline connectors and said sensors.

10. An apparatus as set forth in claim 6 wherein said electrical conductors includes first and second electrical signal conductors, a ground conductor, and a power conductor, said first electrical signal conductor being interrupted by disconnection of said selected sensor from said one of said inline conductors, said second electrical signal conductor, ground conductor and power conductor being uninterrupted by disconnection of said selected sensor from said one of said inline conductors.

11. An apparatus comprising a base which is connectable with a support, a cable containing electrical conductors, a female connector at a first end portion of said cable and connected with said electrical conductors, a male connector at a second end portion of said cable and connected with said electrical conductors, an inline connector disposed between said male and female connectors and connected with said electrical conductors, said inline connector being connected with said base, and a sensor having terminals which are engagable with terminals in said inline connector to connect said sensor with said electrical conductors in said cable, said inline connector is connectable with said base when said inline connector is in a first orientation relative to said base with a portion of said cable extending in a first direction from said base and when said inline connector is in a second orientation relative to said base with said portion of said cable extending in a second direction from said base, said sensor having a first set of terminals which are engaged by said terminals of said inline connector when said when said inline connector is in the first orientation relative to said base, said sensor having second set of terminals which are engaged by said terminals of said inline connector when said inline connector is in the second orientation relative to said base.

12. An apparatus as set forth in claim 11 wherein said base includes gripper means for gripping said inline connector with said inline connector in a first orientation relative to said base and with a portion of said cable extending in a first direction from said base and for gripping said inline connector with said inline connector in a second orientation relative to said base and with said portion of said cable extending in a second direction from said base, said second direction is opposite to said first direction.

13. An apparatus as set forth in claim 11 further including a seal member disposed between said inline connector and said sensor to retard movement of foreign material through a joint between said inline connector and said sensor.

14. An apparatus as set forth in claim 11 wherein said sensor includes a first series of terminals which are engagable with said terminals of said inline connector when said inline connector is in a first orientation relative to said base and a second series of terminals which are engagable with said terminals of said inline connector when said inline connector is in a second orientation relative to said base.

15. An apparatus as set forth in claim 14 wherein said first series of terminals and said second series of terminals each include first and second electrical signal conductor terminals, a ground conductor terminal and a power conductor terminal.

16. An apparatus comprising a base which is connectable with a support, a cable containing electrical conductors, a female connector at a first end portion of said cable and connected with said electrical conductors, a male connector at a second end portion of said cable and connected with said electrical conductors, an inline connector disposed between said male and female connectors and connected with said electrical conductors, said inline connector being connected with said base, and a sensor having terminals which are engagable with terminals in said inline connector to connect said sensor with said electrical conductors in said cable, said base includes gripper means for gripping said inline connector with said inline connector in a first orientation relative to said base and with a portion of said cable extending in a first direction from said base and for gripping said inline connector with said inline connector in a second orientation relative to said base and with said portion of said cable extending in a second direction from said base, said second direction is opposite to said first direction.

17. An apparatus as set forth in claim 16 further including a seal member disposed between said inline connector and said sensor to retard movement of foreign material through a joint between said inline connector and said sensor.

18. An apparatus as set forth in claim 16 wherein said sensor includes a first series of terminals which are engagable with said terminals of said inline connector when said inline connector is in the first orientation relative to said base and a second series of terminals which are engagable with said terminals of said inline connector when said inline connector is in the second orientation relative to said base.

19. An apparatus as set forth in claim 16 wherein said first series of terminals and said second series of terminals each includes first and second electrical signal conductor terminals, a ground conductor terminal and a power conductor terminal.

20. An apparatus comprising a base which is connectable with a support, a cable containing electrical conductors, a female connector at a first end portion of said cable and connected with said electrical conductors, a male connector at a second end portion of said cable and connected with said electrical conductors, an inline connector disposed between said male and female connectors and connected with said electrical conductors, said inline connector being connected with said base, a sensor having terminals which are engagable with terminals in said inline connector to connect said sensor with said electrical conductors in said cable, and a seal member disposed between said inline connector and said sensor to retard movement of foreign material through a joint between said inline connector and said sensor.

21. An apparatus comprising a base which is connectable with a support, a cable containing electrical conductors, a female connector at a first end portion of said cable and connected with said electrical conductors, a male connector at a second end portion of said cable and connected with said electrical conductors, an inline connector disposed between said male and female connectors and connected with said electrical conductors, said inline connector being connected with said base, and a sensor having terminals which are engagable with terminals in said inline connector to connect said sensor with said electrical conductors in said cable, said sensor includes a first series of terminals which are engagable with said terminals of said inline connector when said inline connector is in a first orientation relative to said base and a second series of terminals which are engagable with said terminals of said inline connector when said inline connector is in a second orientation relative to said base.

22. An apparatus as set forth in claim 21 wherein said electrical conductors include first and second electrical signal conductors, a ground conductor, and a power conductor, said first electrical signal conductor being interrupted by disconnection of said sensor from said inline connector, said second electrical signal conductor, ground conductor and power conductor being uninterrupted by disconnection of said sensor from said inline connector.

23. An apparatus as set forth in claim 21 wherein said inline connector is connectable with said base when said inline connector is in the first orientation relative to said base with a portion of said cable extending in a first direction from said base and when said inline connector is in the second orientation relative to said base with said portion of said cable extending in a second direction from said base.

24. An apparatus as set forth in claim 23 wherein said base includes gripper means for gripping said inline connector with said inline connector in the first orientation relative to said base and with a portion of said cable extending in the first direction from said base and for gripping said inline connector with said inline connector in the second orientation relative to said base and with said portion of said cable extending in the second direction from said base.

25. An apparatus as set forth in claim 21 further including a seal member disposed between said inline connector and said sensor to retard movement of foreign material through a joint between said inline connector and said sensor when said inline connector is in the first orientation and when said inline connector is in the second orientation.

* * * * *